US010071389B2

(12) United States Patent
Clough et al.

(10) Patent No.: US 10,071,389 B2
(45) Date of Patent: Sep. 11, 2018

(54) DISPENSING DEVICE

(71) Applicant: Reckitt Benckiser (Brands) Limited, Slough, Berkshire (GB)

(72) Inventors: Richard Brian Clough, Warwick (GB); Jacobus Simon Petrus Van Diepen, Dongguan (CN)

(73) Assignee: Reckitt Benckiser (Brands) Limited, Slough, Berkshire (GB)

( * ) Notice: Subject to any disclaimer, the term of this patent is extended or adjusted under 35 U.S.C. 154(b) by 0 days.

(21) Appl. No.: 15/123,361

(22) PCT Filed: Mar. 12, 2015

(86) PCT No.: PCT/GB2015/050718
§ 371 (c)(1),
(2) Date: Sep. 2, 2016

(87) PCT Pub. No.: WO2015/140515
PCT Pub. Date: Sep. 24, 2015

(65) Prior Publication Data

US 2017/0065992 A1 Mar. 9, 2017

(30) Foreign Application Priority Data

Mar. 19, 2014 (GB) ..... 1404950.6

(51) Int. Cl.
*B67D 1/00* (2006.01)
*B05B 9/043* (2006.01)
(Continued)

(52) U.S. Cl.
CPC ..... *B05B 9/043* (2013.01); *A47K 5/1217* (2013.01); *B05B 9/0861* (2013.01);
(Continued)

(58) Field of Classification Search
CPC ..... B05B 9/043; B05B 9/0861; B05B 12/122; B05B 15/061; B05B 15/065; B05B 15/069; B95B 11/0091; A47K 5/1215
(Continued)

(56) References Cited

U.S. PATENT DOCUMENTS 6,161,737 A 12/2000 Leary
6,247,621 B1 6/2001 Lewis
(Continued)

FOREIGN PATENT DOCUMENTS

WO 2010055314 A1 5/2010
WO 2012056220 A1 5/2012

OTHER PUBLICATIONS

International Search Report and Written Opinion of the International Searching Authority for corresponding application PCT/GB2015/050718 dated Jun. 17, 2015.
(Continued)

*Primary Examiner* — Lien Ngo
(74) *Attorney, Agent, or Firm* — Norris McLaughlin & Marcus PA

(57) ABSTRACT

Disclosed is a dispensing device comprising a base unit and an articulated arm portion which extends from a part of the base unit, the base unit further comprises an actuation mechanism which includes a capacitive-type sensor for dispensing liquid and adapted to receive a refill unit insertible into the base unit in an inverted configuration with its outlet lowermost for the supply of liquid to the base unit.

11 Claims, 16 Drawing Sheets

(51) Int. Cl.

| | |
|---|---|
| ***B05B 15/62*** | (2018.01) |
| ***B05B 15/65*** | (2018.01) |
| ***B05B 15/658*** | (2018.01) |
| ***A47K 5/12*** | (2006.01) |
| ***B05B 9/08*** | (2006.01) |
| ***B05B 11/00*** | (2006.01) |
| ***B05B 15/06*** | (2006.01) |
| ***B05B 12/12*** | (2006.01) |

(52) U.S. Cl.
CPC ..... *B05B 11/0091* (2013.01); *B05B 12/122* (2013.01); *B05B 15/061* (2013.01); *B05B 15/065* (2013.01); *B05B 15/069* (2013.01); *B05B 15/62* (2018.02); *B05B 15/65* (2018.02); *B05B 15/658* (2018.02)

(58) Field of Classification Search
USPC ..... 22/52, 63, 180, 181.1–181.3, 185.1; 222/52, 63, 180, 181.1–181.3, 185.1, 571, 222/321.3
See application file for complete search history.

(56) References Cited

U.S. PATENT DOCUMENTS

| | | | | |
|---|---|---|---|---|
| 7,337,989 | B1 * | 3/2008 | Penner | A47K 3/281 239/210 |
| 8,757,454 | B2 * | 6/2014 | Dong | B05B 11/3097 222/321.3 |
| 8,893,928 | B2 * | 11/2014 | Proper | B67D 7/76 222/173 |
| 2010/0213279 | A1 * | 8/2010 | Frederick | B05B 1/18 239/310 |
| 2010/0258594 | A1 | 10/2010 | Carta et al. | |
| 2012/0111884 | A1 | 5/2012 | Choi | |
| 2013/0001241 | A1 | 1/2013 | Ophardt et al. | |
| 2014/0231450 | A1 | 8/2014 | Rosko et al. | |

OTHER PUBLICATIONS

GB Search Report for corresponding application GB 1404950.6 dated Sep. 26, 2014.

* cited by examiner

DISPENSING DEVICE

The present application is a 35 USC 371 application of PCT/GB2015/050718 filed on 12 Mar. 2015, which in turn is based on GB 1404950.6 filed 19 Mar. 2014, the entirety of the disclosures of which are herein fully incorporated by reference. The applicant claims all available priority benefit to the foregoing applications.

The present invention relates to an improved dispensing device, useful in the delivery of a liquid treatment composition from a refill container which is removably contained within the dispensing device to a user or consumer of the liquid. Preferably the liquid is a viscous composition, such as a liquid soap or a liquid sanitizing composition, which may be largely aqueous, largely alcoholic or a largely aqueous-alcoholic based composition.

Devices for the dispensing of a liquid, such as a liquid hand soap or other topical treatment composition are per se, generally known to the art. One such device is disclosed in WO 2010/055314 to a "Dispenser and Refill Unit", the contents of which are herein fully incorporated by reference.

The dispensing device according to the present invention provides an improvement over the device of WO 2010/055314. The dispensing device of the present invention comprises a base unit into which a refill unit containing the liquid treatment composition to be dispensed is fitted in an inverted configuration, namely with its outlet at the lowermost end. The dispensing device present invention is particularly suited for use as a free-standing dispensing device suitable for use in a domestic environment. However, it could also be reconfigured for use as a wall-mounted unit by the provision of suitable modifications, e.g, by providing a bracket, a hanger or other means wherein the base could be affixed to a wall or other surface. The dispensing unit could also be used in larger scale installations, such as public lavatories. The dispensing device unit may have a manually operated pump to dispense the liquid treatment composition, but it is preferably provided with a proximity sensor based on a capacitive-type sensor which senses the presence of the user's hand in the near proximity of the base of the dispensing device and which further includes a pump to automatically dispense the liquid treatment composition in response to sending the near proximity of the user's hand or other body part.

As the dispensing device is primarily intended for the domestic market, it is essential that a consumer can replace a refill unit in a manner which is very easy, foolproof and without mess which is at best an annoyance for the consumer and at worst could destroy the dispensing mechanism. Further, as the dispensing device is primarily intended to be a self standing, or portable device, it is desirable that the configuration of the dispensing device be configurable to facilitate its efficient packaging in a reduced volume when both presented as a packaged vendible article, as well as to facilitate its transport between uses by a user of the said device.

The dispensing device includes an articulated arm portion which extends from a part of the base of the dispensing device through which portion the liquid treatment composition may be ultimately dispensed to a user. The articulated arm portion is moveable with respect to the base, and in a first position with respect to the base of the base unit establishes a "dispensing configuration" in which position the, but in a second position with respect to the base of the base unit establishes a "storage configuration". In the former configuration the refill unit may be present in the base unit, while it the latter configuration the position of the articulated arm portion denies for the placement of the refill unit within the base unit. The storage configuration provides for a more compact, viz., shorter, configuration of the base unit which facilitates its packaging and transport between uses of the device, as compared to the first, dispensing configuration.

In a preferred aspect the dispensing device comprises a base unit with an actuation mechanism for dispensing liquid and a refill unit insertable into the base unit in an inverted configuration with its outlet lowermost for the supply of liquid to the base unit, the refill unit comprising an annular wall projecting into the refill unit and defining an outlet from the refill unit, the annular wall being closable at its innermost end by a valve element biased onto the annular wall, the base unit comprising a hollow spigot and an annular seal surrounding and spaced from the top of the spigot, whereby insertion of the refill unit into the base unit causes the spigot to enter the annular wall and to lift the valve element from the annular wall to define a flow path from the refill unit, through at least one cut-out portion formed in the top of the spigot and/or the bottom of the valve element and down the hollow spigot, and the annular seal to seal between the spigot and the annular wall. Such an arrangement provides a mechanism by which the refill unit can simply be lowered onto the spigot. This causes the flow path to be opened up. During the opening process, the annular seal forms a seal with the annular wall thereby preventing leakage even during the opening process. The present invention therefore provides a simple and mess free way of replacing the refill unit even when the refill has not been completely emptied.

The cut-out portion could be formed in the bottom of the valve element. However, this would also require the valve seat to be shaped to match the cut-out portion on the valve element. It is therefore preferable for the cut-out portion to be on the top of the spigot. Preferably, there is more than one cut-out portion to provide a plurality of flow paths. In the preferred example, the cut-out portions effectively take the form of castellations on the top of the spigot The valve element could be biased by a spring which is on the opposite side of the valve element from the annular wall. Preferably however, the valve element is biased by at least one resilient member which is preferably joined at one end to the valve element and at the other end at a location radially outwardly of and below the innermost end of the annular wall, the or each resilient member being configured so that when the valve element is lifted from the annular wall, a flow path is present between the valve element and the annular wall.

By using at least one resilient member anchored outside of the annular wall, the structure of the device can be greatly simplified as the resilient elements themselves and the means by which they are anchored can be integrated into the existing structure of the refill unit. If the valve element was to be resiliently supported on its opposite side, then an additional structure would be required to support this, thereby complicating the design. Thus preferably, the refill unit comprises an opening at one end which, in use, is the lowermost end, the opening comprising an annular wall projecting into the unit and being closable at its innermost end by a valve element biased onto the annular wall, wherein the valve element is biased by at least one resilient member with joined at one end to the valve element and at the other end to a location radially outwardly of and below the innermost end of the annular wall, the or each resilient member being configured so that, when the valve element is lifted from the annular wall, a flow path is present between the valve element and the annular wall. If only a single biasing element is used, it could not be a continuous annular component, but would have to have holes in or be a helical structure, or similar, so that the flow path could be present. Preferably, there are a plurality of resilient elements with gaps therebetween to provide the flow path.

The resilient member, or where a plurality of such are present each resilient member, may be manufactured separately from the valve element and fixed together. However, preferably, the valve element is manufactured integrally with the or each resilient member. The resilient member, or where a plurality of such are present, each resilient member, preferably extends into a surrounding valve plate which is secured to the cap of the refill unit. The valve plate may simply be glued, adhered or otherwise fixed within the cap. However, preferably, the valve plate is sandwiched between the cap and a fixing plate which may snap into place. Preferably, one or more fixing posts are provided in one of the cap, valve plate or fixing plate in order to locate the various elements with respect to one another.

The opening in the refill unit may be a liquid outlet or an air relief inlet. The structure of the annular wall, valve element and resilient member is equally applicable to either.

An embodiment of a dispensing device according to the present invention is described with reference to the accompanying drawings in which:

FIGS. 1A, 1B and 1C respectively illustrate side, front and rear elevational views of a dispensing device of the invention including a refill unit installed in the base unit.

FIGS. 2A and 2B respectively illustrate the dispensing device with the articulated arm portion in a "dispensing configuration" (FIG. 2A) and in a "storage configuration" (FIG. 2B).

Figure 1A:
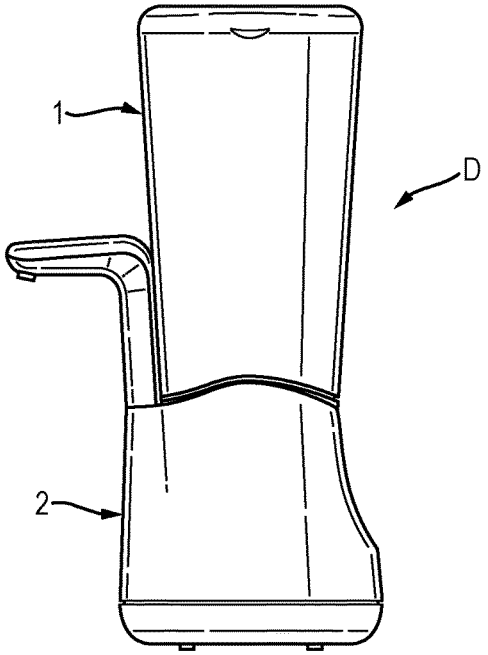
Figure 1B:
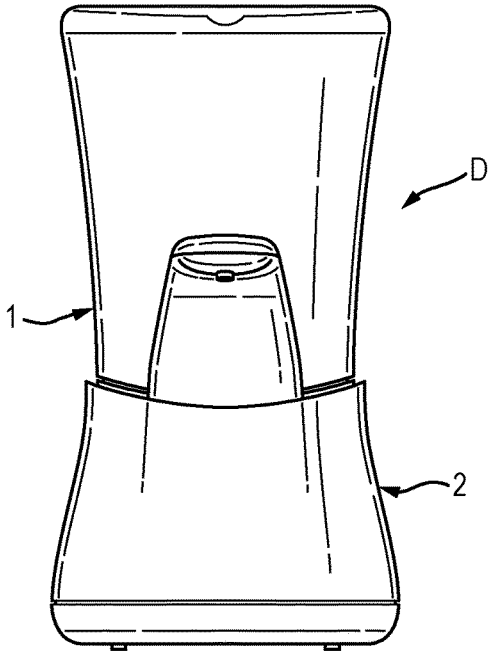
Figure 1C:
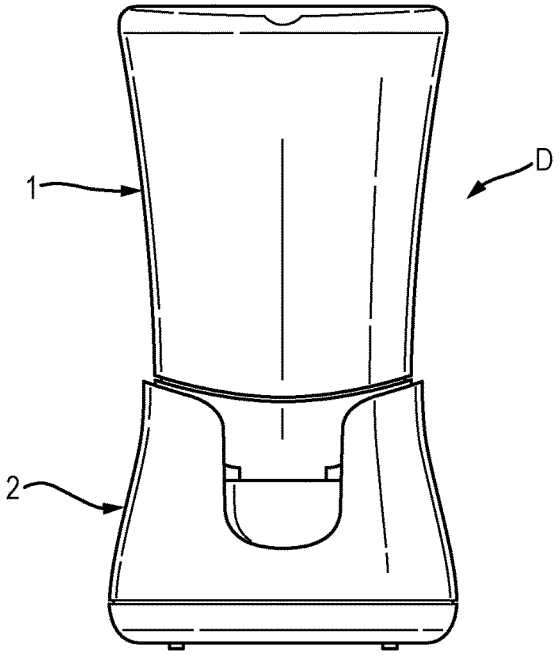
Figure 2A:
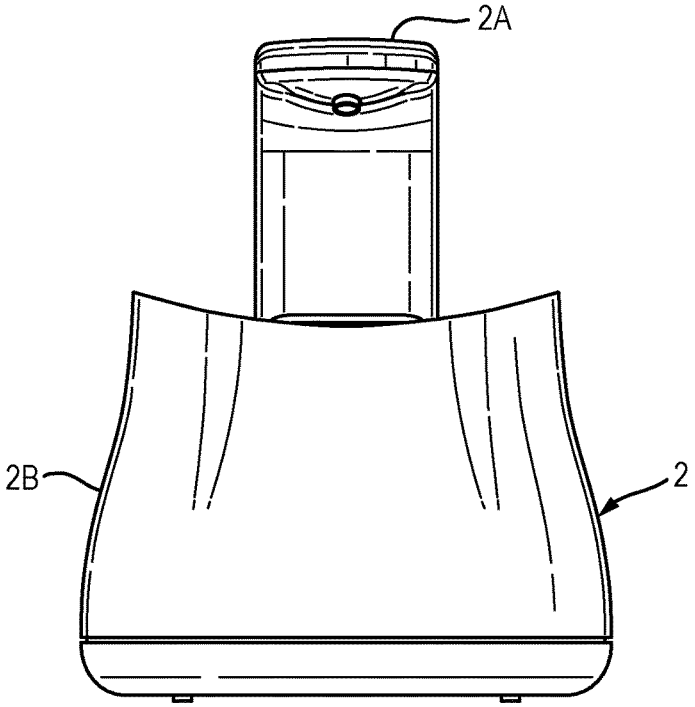
Figure 2B:
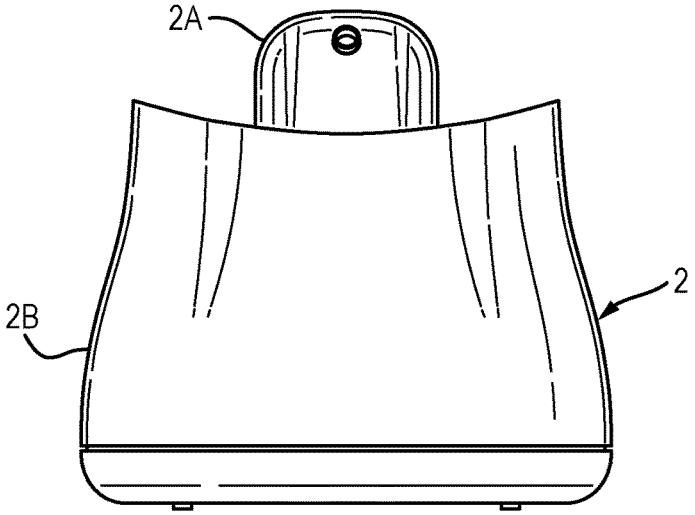
Figure 3:
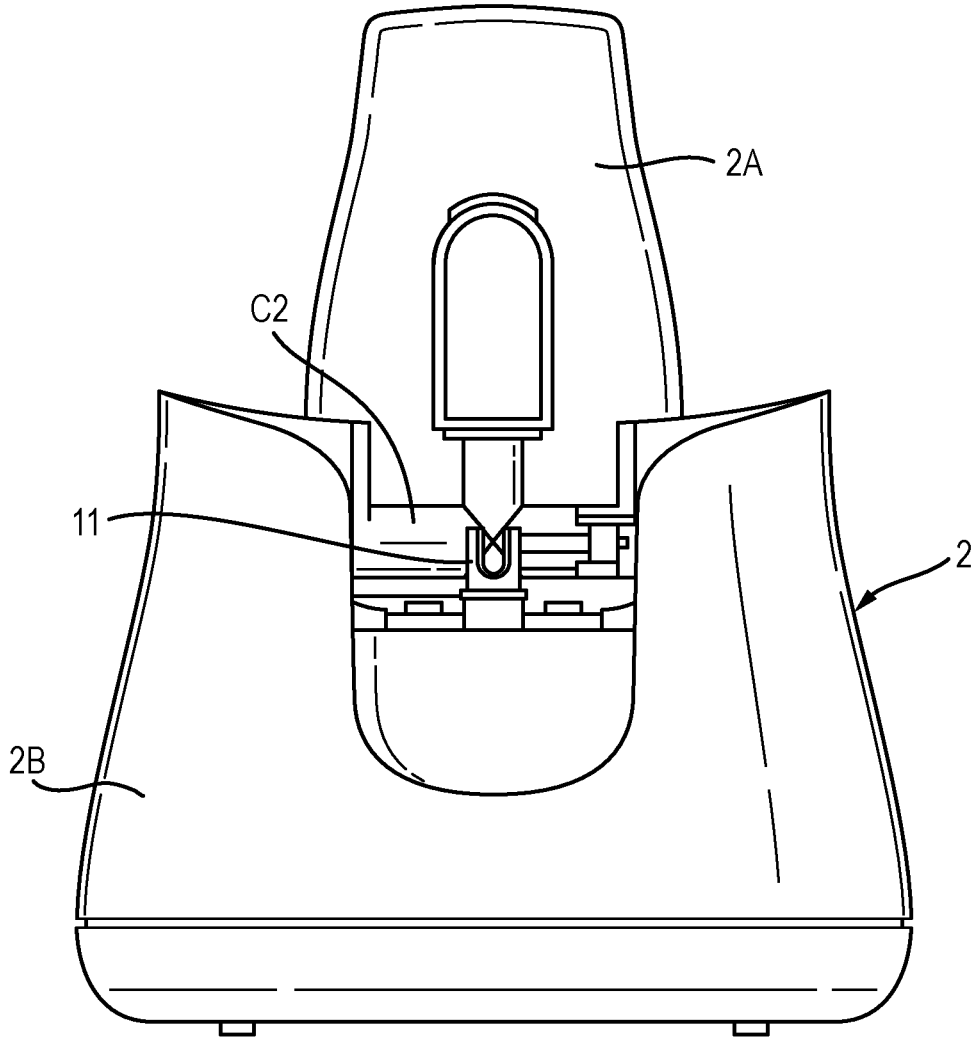
FIG. 3 illustrates an elevational view of the rear of the dispensing device in a dispensing configuration, and with the refill unit being absent from the base unit.
Figure 4:
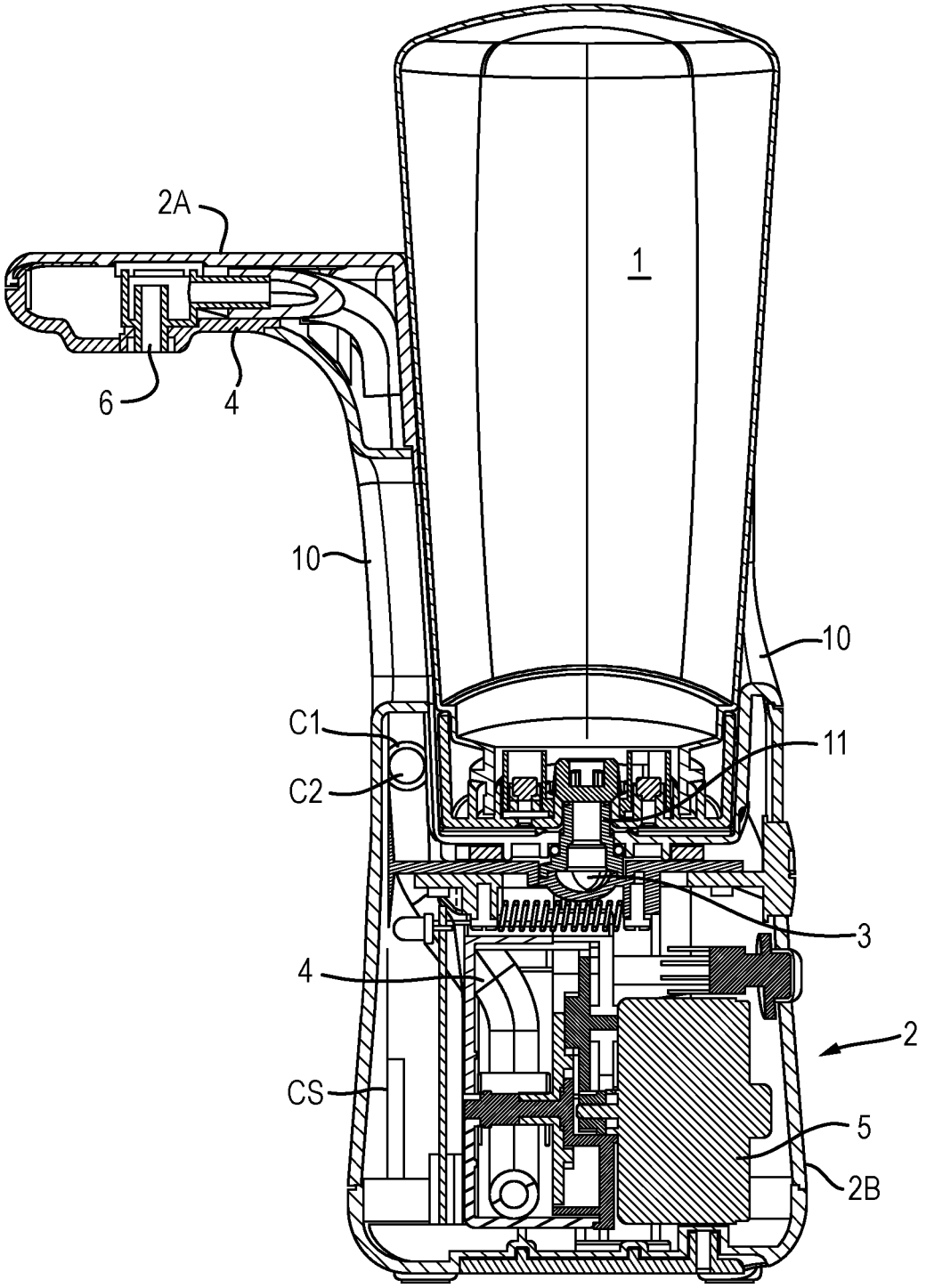
FIG. 4 illustrates a side, cross-sectional view of the dispensing device and refill unit illustrating certain elements within the base of the base unit including the placement of the capacitive-type sensor within the base.
Figure 5A:
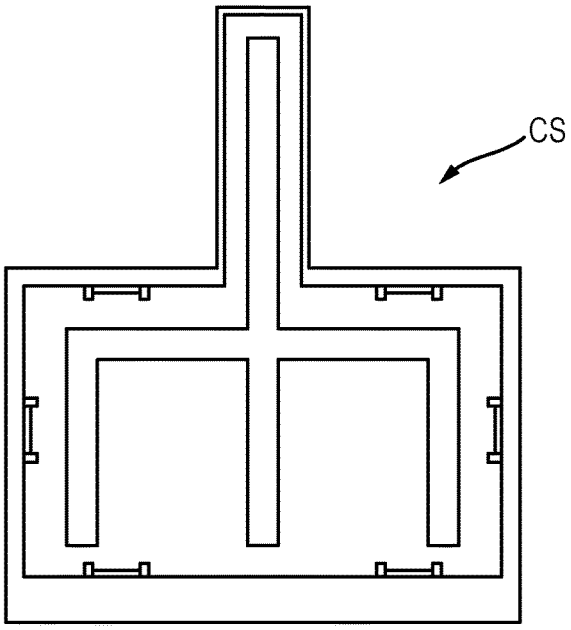
Figure 5B:
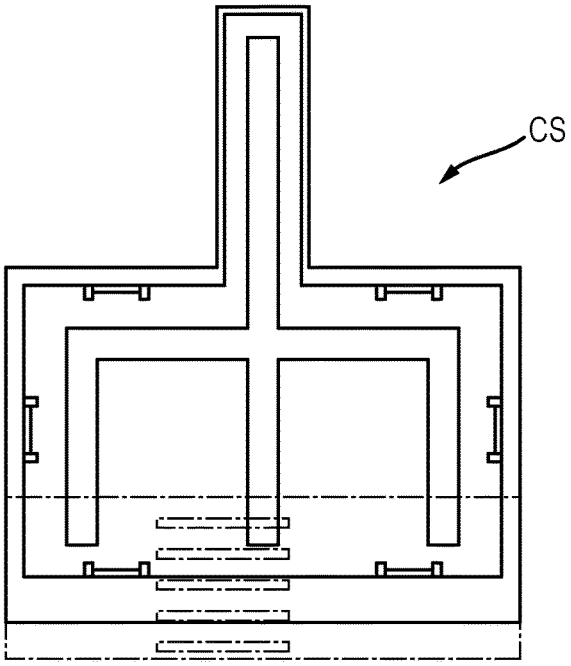

FIGS. 5A and 5B respectively depict the front and back views of the capacitive-type sensor which illustrate the two faces of this sensor.

Figure 6:
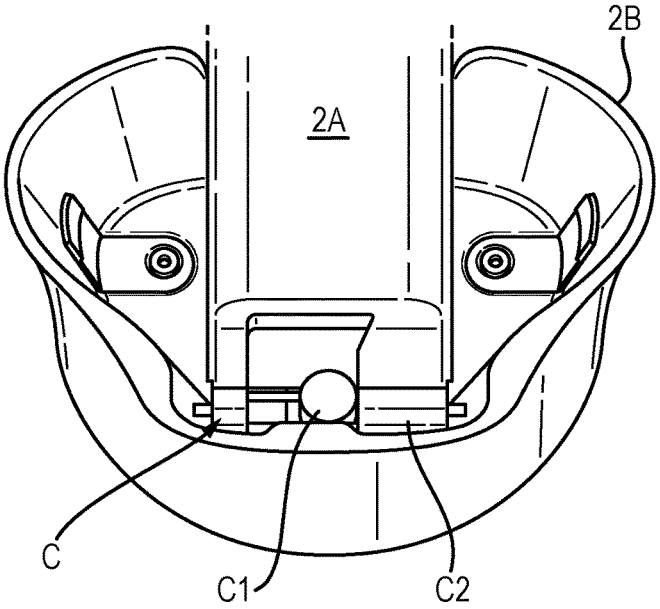

FIG. 6 depicts a portion of the base unit with the articulated arm portion rotated to be at least partly within the base unit and thus is in a storage configuration.

Figure 7:
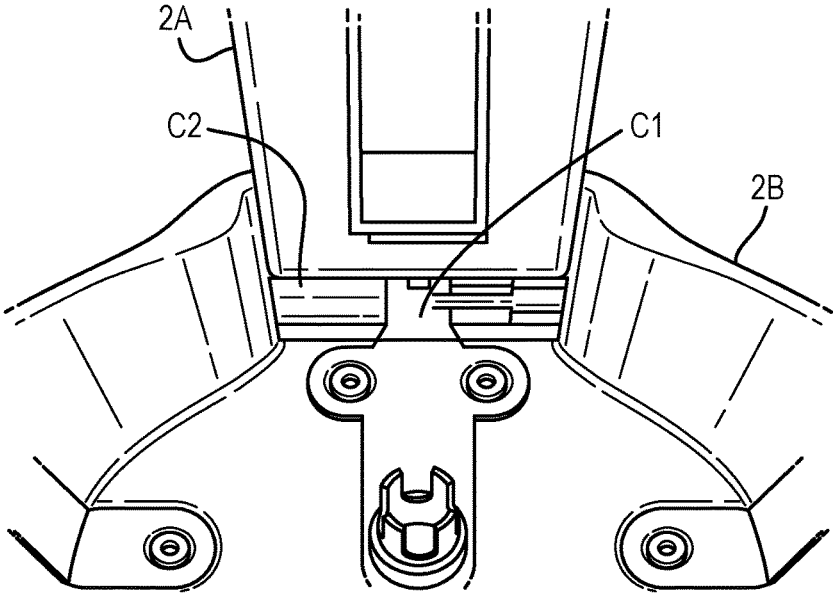

FIG. 7 illustrates a portion of the base unit with a view to its interior with the refill unit not being present, which also illustrates the articulated arm portion in an upright orientation with respect to the base unit, and thus is in a dispensing configuration.

Figure 7A:
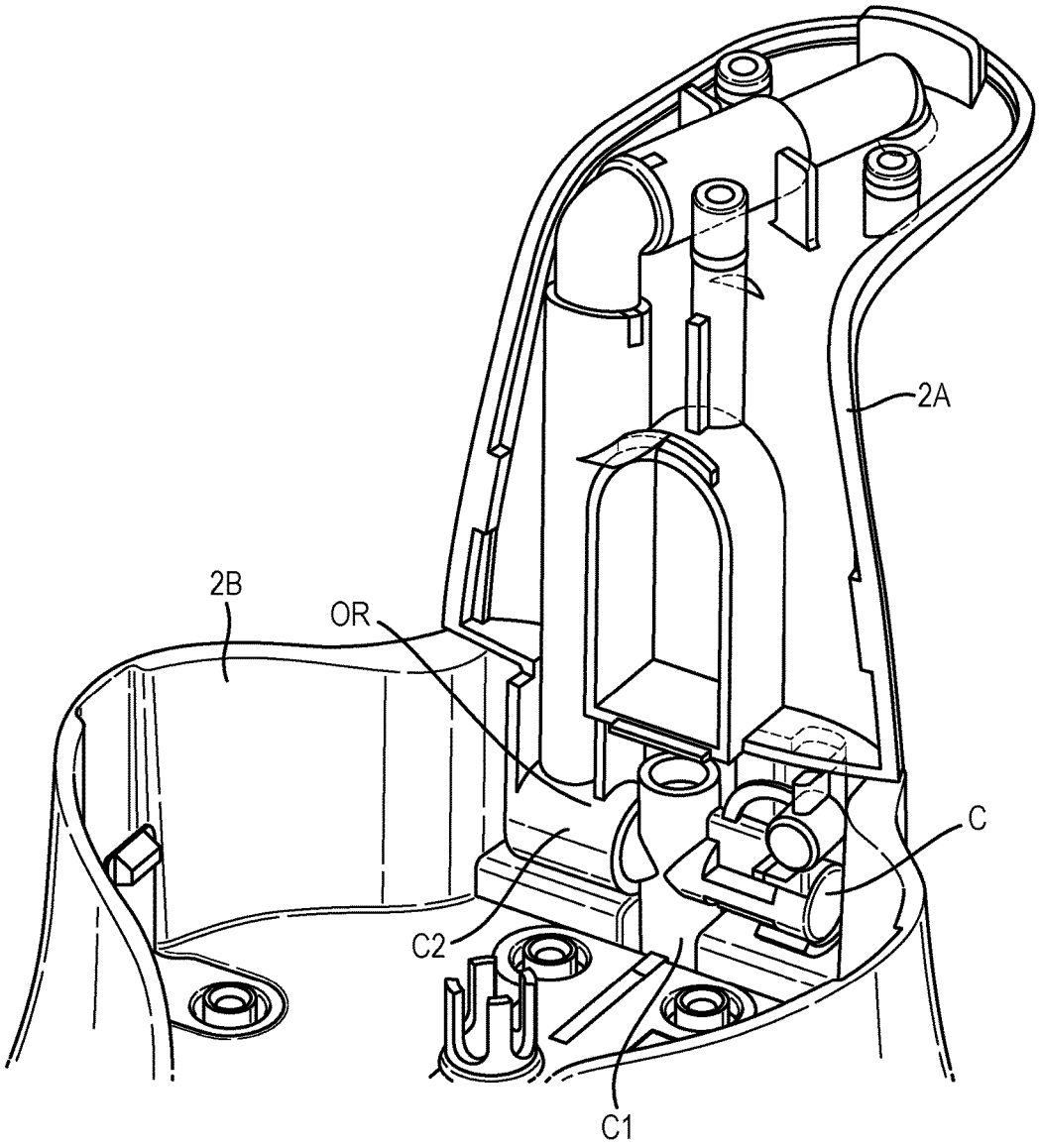

FIG. 7A depicts a partial cut-way view of further details of the elements of the base unit and the articulated arm portion in a dispensing configuration.

Figure 8A:
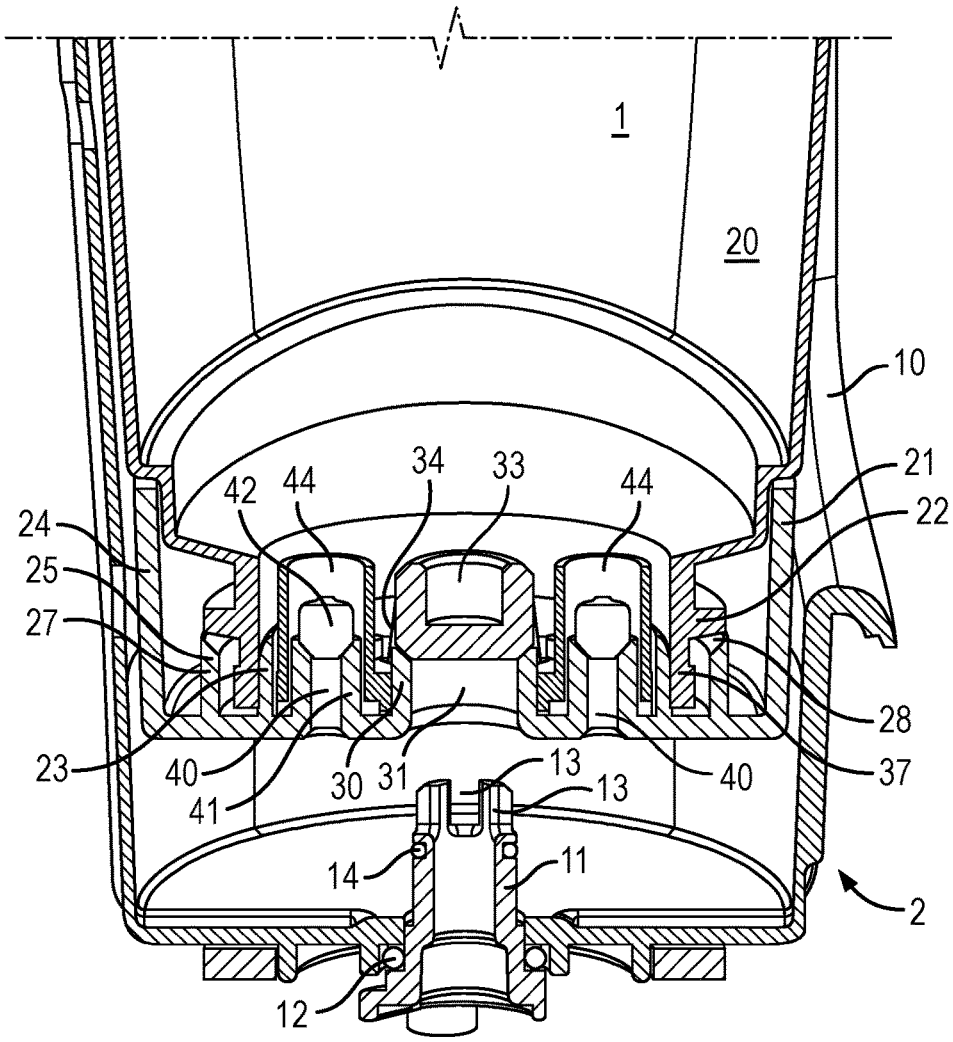

FIG. 8A is a cut-away perspective view of a part of the refill unit being introduced into the dispensing device, but not yet being engaged.

Figure 8B:
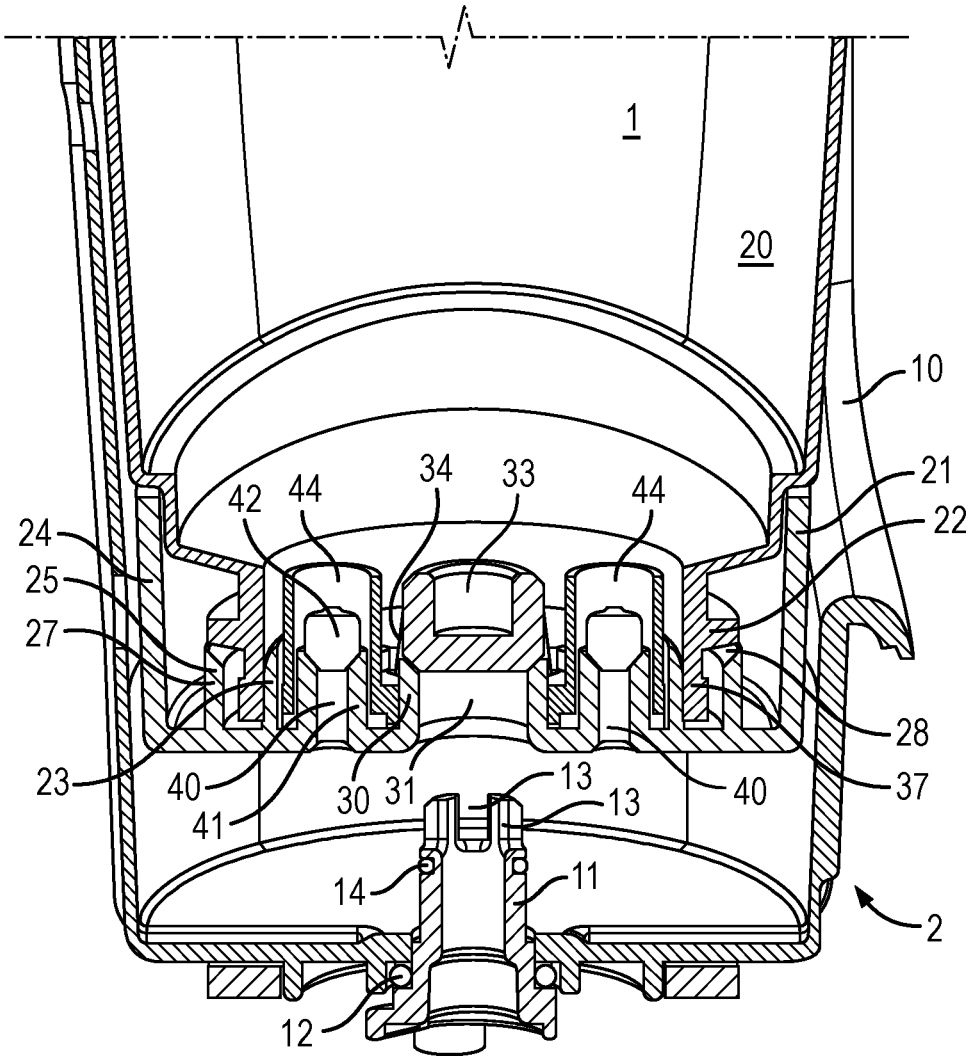

FIG. 8B is a is a cut-away perspective view of a part of the refill unit being partially engaged with introduced into the dispensing device, similar to but subsequent to the illustration of FIG. 8A.

Figure 8C:
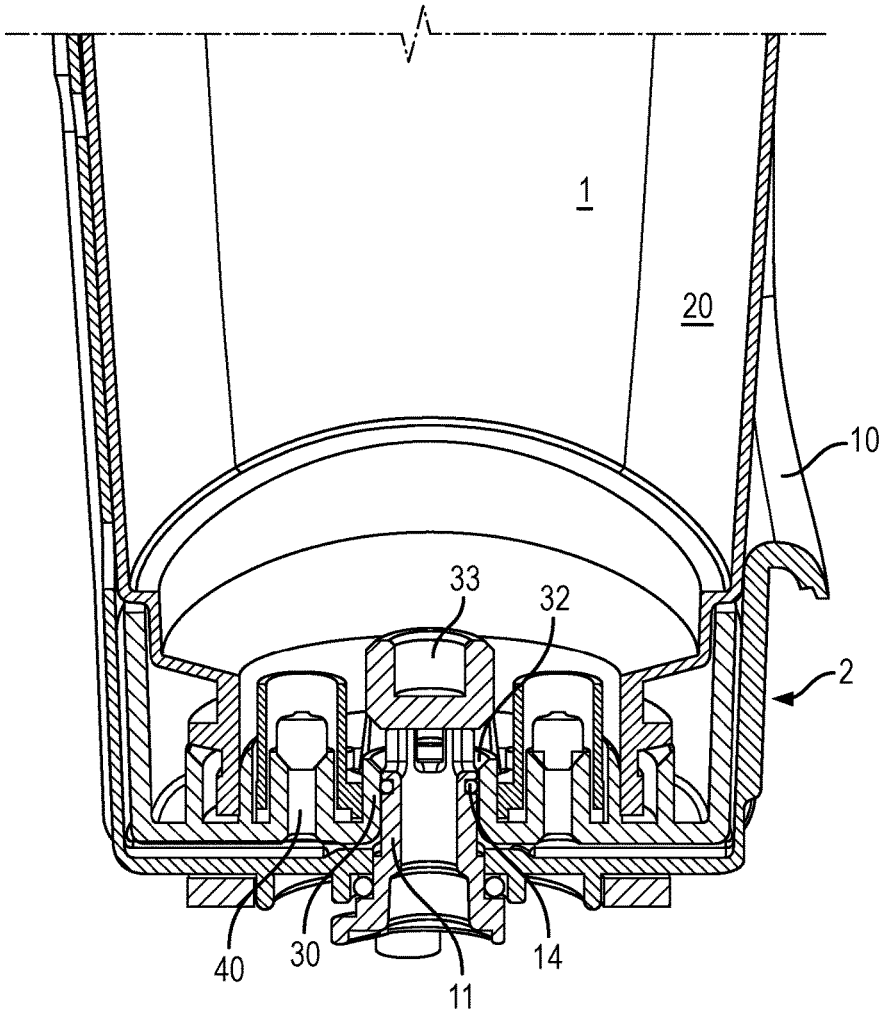

FIG. 8C is a cut-away perspective view of a part of the refill unit being fully engaged with the dispensing device, similar to but subsequent to the illustrations of FIGS. 8A and 8B.

Figure 8D:
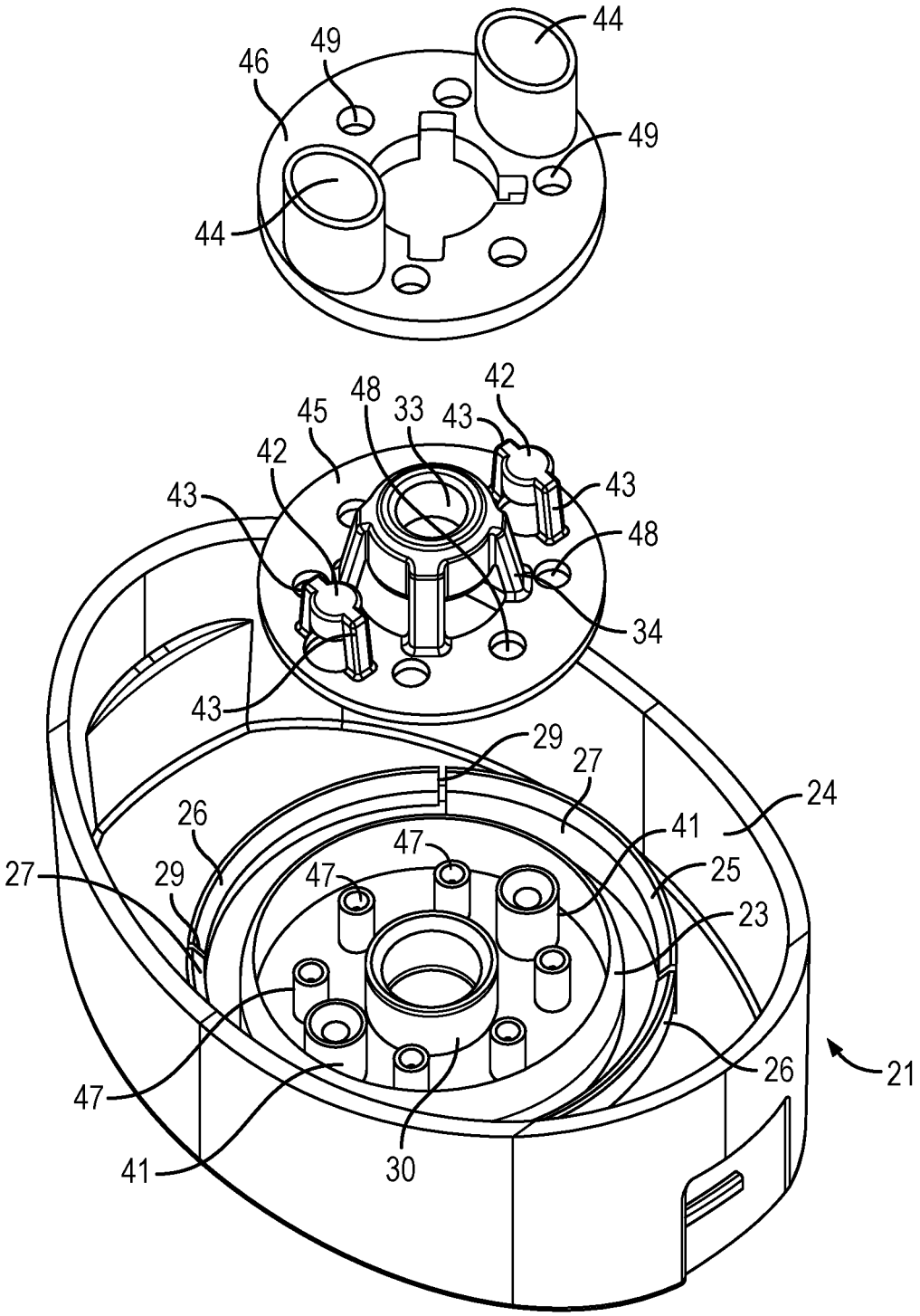

FIG. 8D is an exploded view of the elements of a cap of the refill unit.

Figure 8E:
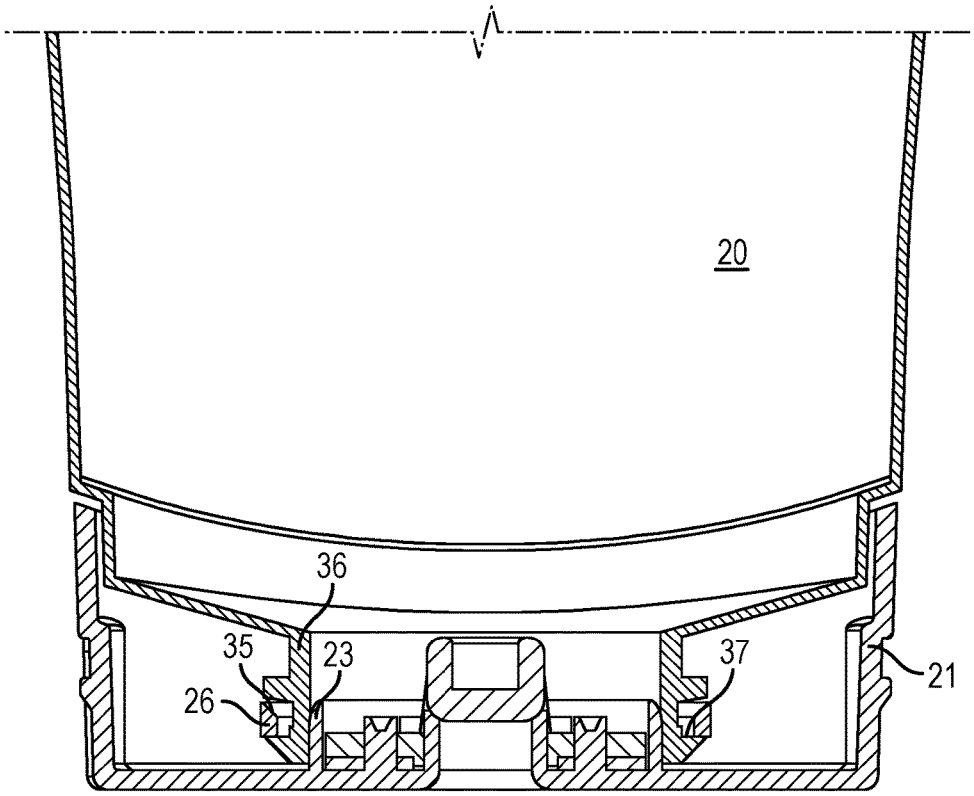

FIG. 8E is a cross-sectional view of parts of the refill unit.

Figure 9A:
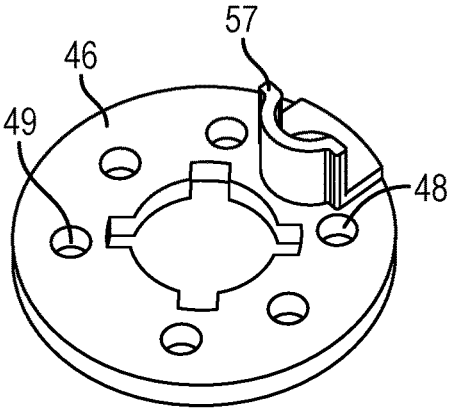
Figure 9A:
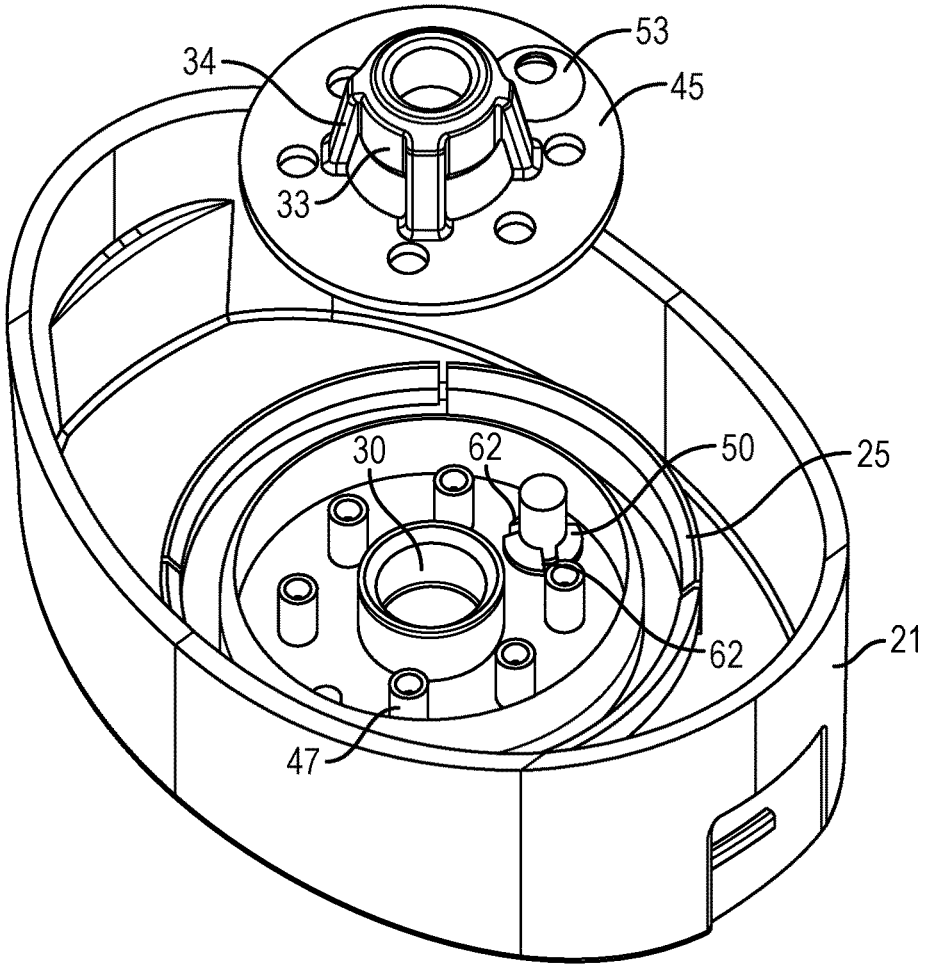
Figure 9B:
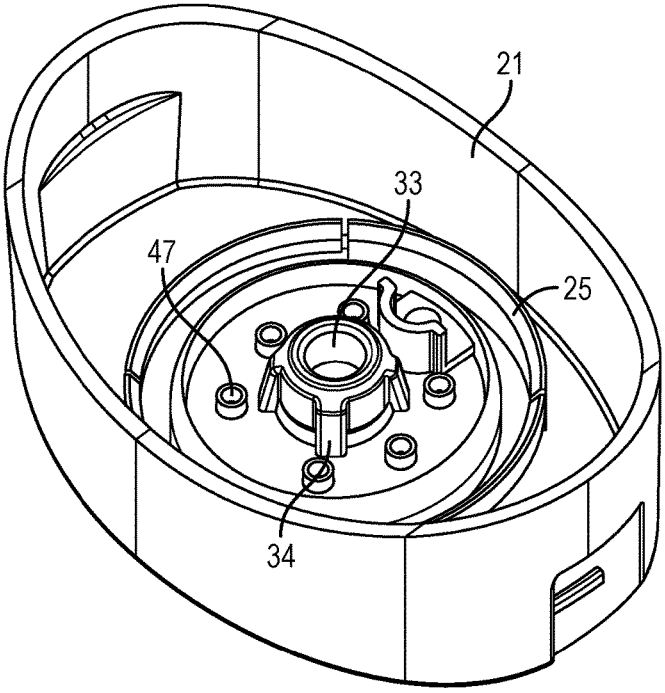

FIGS. 9A and 9B depict two views of a second embodiment of a cap of the refill unit.

Figure 9C:
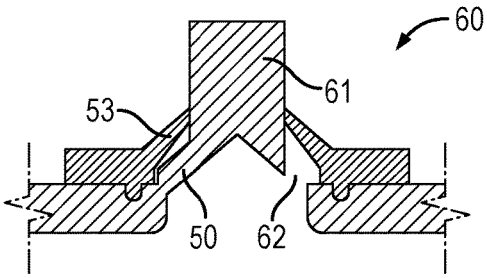
Figure 9D:
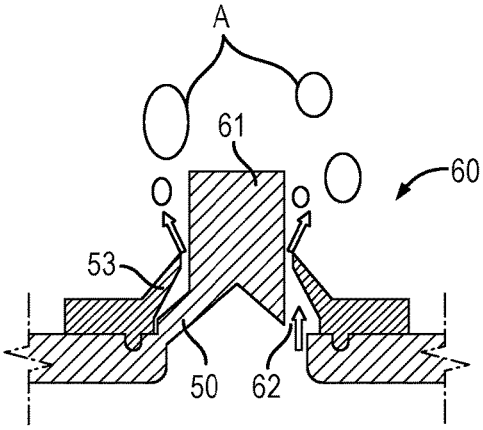

FIGS. 9C and 9D illustrate in a cross-sectional view a part of the cap of the refill unit.

Figure 10A:
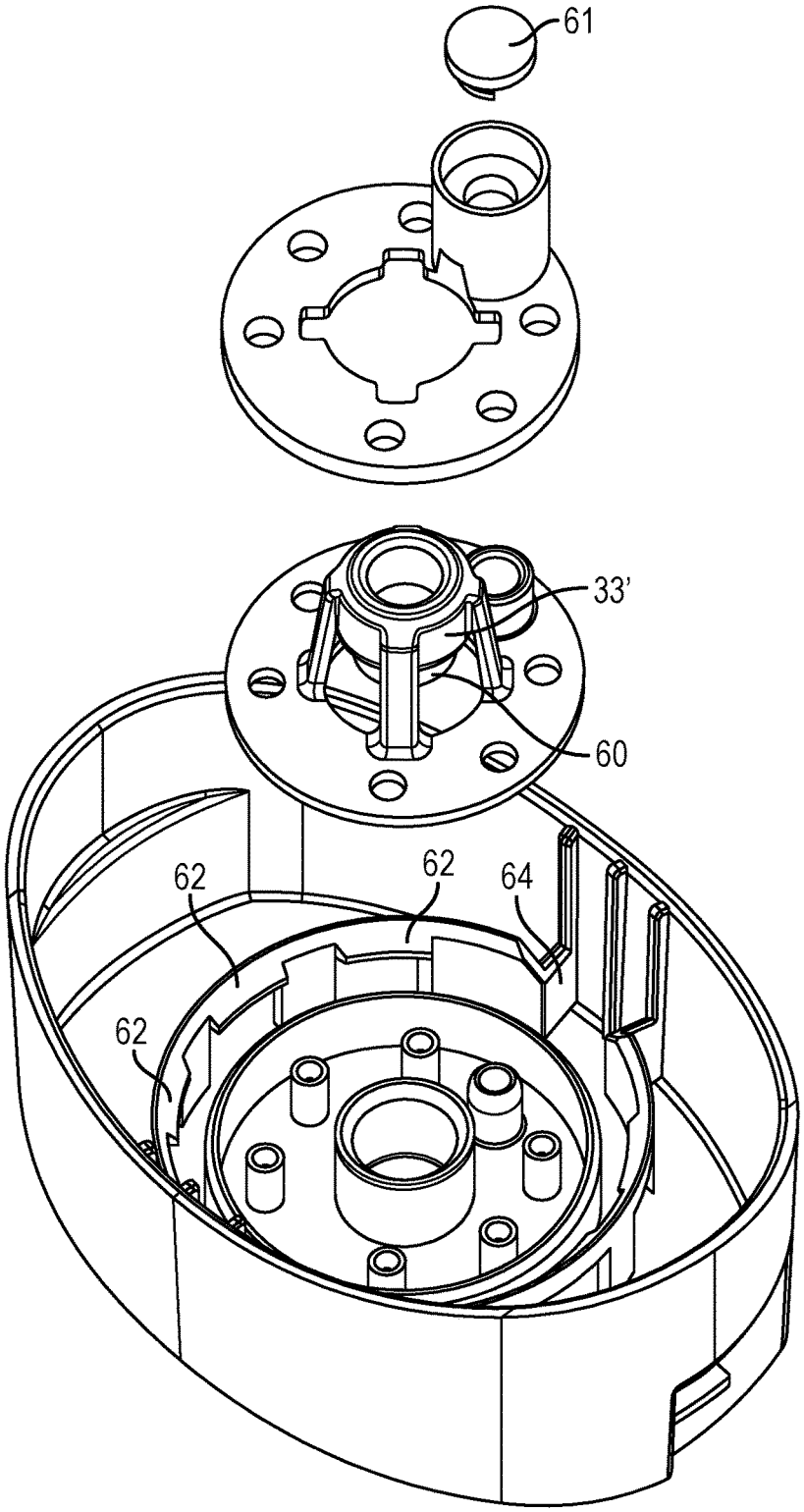
Figure 10B:
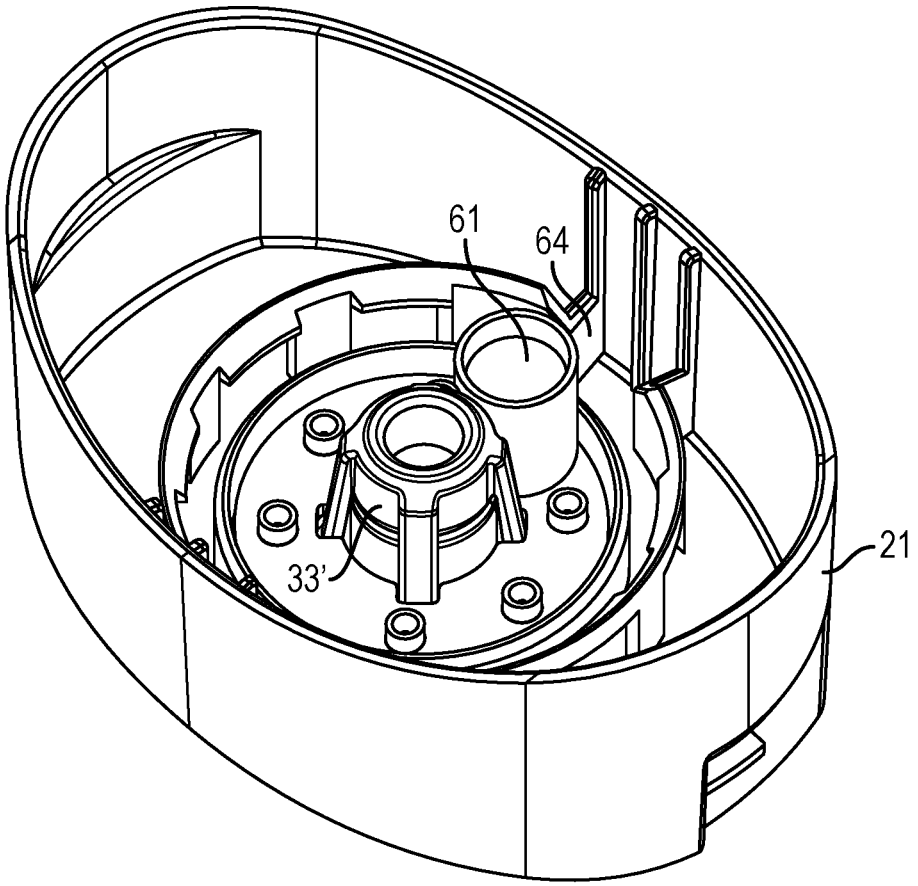

FIGS. 10A and 10B depict two views of a further alternative embodiment of a cap of the refill unit.

Reference is made to the figures of this patent application, wherein like elements are identified by the same reference numeral(s) a/o reference letter(s).

The dispensing device is a hands-free dispenser which is generally suitable for domestic use. The dispensing device dispenser is primarily intended to dispense liquid soap, but may also be used to dispense other liquid or semi-liquid products (ideally with a viscosity greater than water), such as hand cream, body lotion, moisturizer, face cream, shampoo, shower gel, foaming hand wash, shaving cream, washing up liquid, toothpaste, acne treatment cream, a surface cleaner or a sanitizing agent such as alcohol gel.

The dispensing device D dispenser comprises two main parts, namely a refill 1 and a base unit 2. The refill 1 provides a reservoir of liquid to be dispensed and is fitted to the base unit 2 as described hereinafter.

With reference to FIGS. 2A, 2B, 3, 6, 7 and 7A, the base unit 2 includes a base part 2B and an rotatable arm part 2A which is moveable, with respect to the base part 2B by a fluid coupling element C which is most clearly visible from FIGS. 6, 7 and 7A. As is visible thereon the fluid coupling element C comprises a fluid stem part C1 which is in fluid connection with the pump 5 via a part of the dispensing tube 4 which fluid stem part C1 is in turn in further fluid communication with an fluid arm coupling part C2 which forms part of or is connected to the arm part 2A. An O-ring is provided between a portion of the fluid stem part C1 and the coupling arm part C2, the latter of which may be freely rotated about the former. In this preferred configuration the fluid arm coupling part C2 is rotatably connected to the fluid stem part C1 such that the two define a rotational axis about which the fluid arm coupling part C2 may rotate, which in turn also defines an axis with respect to which the rotatable arm part 2A may also rotate with respect to the base part 2B. In this manner, when the refill 1 is not present within the base 2, the rotatable arm part 2A may be manually moved or rotated from the dispensing configuration" (FIG. 2A) and into a "storage configuration" (FIG. 2B), which reduces the overall height of the base 2 making it particularly well suited for packaging, and for transport. When desired, the user of the device may manually move or rotate the rotatable arm part 2A from the "storage configuration" to a "dispensing configuration" at which configuration a refill 1 may be inserted into the base 2, making the dispensing device D ready for its normal use.

While the preferred depicted fluid coupling element C includes a fluid stem part C1 and a fluid arm coupling part C2, it is to be understood that any other suitable means may be used in place of such elements as long as the desired motion of the rotatable arm part 2A with respect to the base part 2B is not unduly compromised or hindered. For example the fluid coupling element may by provided by omitting the fluid stem part C1 and a fluid arm coupling part C2, and in place thereof a short length of flexible tubing (e.g., a part of the dispensing tube 4), or other fluid conduit means may fully satisfy this function and operate as a fluid coupling element C. In such a configuration, it is preferred that a part of the rotatable arm part 2A be affixed to a part of the base part 2B by a suitable means such as a hinge, ball joint, snap fit connection or other mechanical means or element wherein the rotatable arm part 2A be configurable between a "dispensing configuration" and a "storage configuration" with respect to the base part 2B.

The base 2 has an interface 3 into which liquid is dispensed from the refill unit. The interface 3 is in fluid communication with a dispensing tube 4 which extends between the pump 5 and the dispensing head, via the intermediate fluid stem part C1 which forms part of the base part 2B and the fluid arm coupling part C2 which forms part of the rotatable arm part 2A. The pump 5 is selectively operable to pump a metered dose of the liquid through the dispensing tube 4 and out of dispensing head 6. The base part 2B includes in its interior a capacitive-type sensor CS which is configured to sense the presence of a hand or other body part of a user in the near proximity of the base part 2B, but does not require any physical contact with the base part 2B. Control circuitry reacts to a signal from the capacitive-type sensor CS which in turn activates the pump 5. The device may be mains powered or battery powered.

FIGS. 5A and 5B respectively depict the front and back views of the capacitive-type sensor CS which illustrate the two faces of this sensor. The front face, illustrated on FIG. 5A is adapted to sense the proximity of a hand or other body part of a user on the exterior of the base 2, which condition, when sensed causes the capacitive-type sensor CS to transmit an appropriate signal to the circuit board which in turn includes appropriate components a/o logic circuit a/o other control means wherein an appropriate control signal is sent to the pump which operates to dispense a dose of the liquid 20 through the dispensing tube 4 and ultimately out of dispensing head 6, and thereby out from the dispensing device 20. The rear face of the capacitive-type sensor CS, illustrated on FIG. 5B, which is on the obverse face of the capacitive-type sensor CS is positioned so that it is directed inwardly and is adapted to sense water or other liquid, e.g., the liquid 20, which may come into contact with this rear face. When such a condition is sensed, which may occur if the interior of the base part 2A contains water (which may be inadvertently introduced by a user of the dispensing device D), or other liquid, (which may be a quantity of the liquid 20 which may have leaked into the interior of the base part 2A such as by a faulty seal on a part of the base 2 or of the refill unit 1), the capacitive-type sensor CS may send an appropriate signal to the circuit board which in turn includes appropriate components a/o logic circuit a/o other control means which circuit board deactivates one or more further parts of the dispensing device D, e.g. the pump 5, until the fault or undesired condition is corrected. Subsequently the operation of the dispensing device D and the capacitive-type sensor CS may be reinitiated by resetting the device, e.g, by removal of the power source of the circuit board and/or the capacitive-type sensor CS for a short time interval, e.g, 2-60 seconds, before restoring power to the dispensing device D.

The capacitive-type sensor CS is operative without requiring any direct physical contact therewith, viz., does not require that the user actually come into physical contact with any part of the capacitive-type sensor CS or any part of the dispensing device D.

The interface between the refill 1 and base unit 2 will now be described in greater detail with reference to FIGS. 8A, 8B and 8C.

The base 2 comprises a cowling 10 which forms a cup-shaped housing surrounding a significant portion of the refill 1 so to protect and support it. A spigot 11 projects through the base of the cowling 10 and is sealed to the cowling 10 by an O-ring seal 12. The spigot has a plurality of castellations 13 in its top surface. A second O-ring seal 14 surrounds the spigot 11 beneath the castellations 13.

The refill 1 comprises a bottle 20 to which a cap 21 is fixed. The bottle 20 has a neck 22 which fits over and seals with an annular flange 23 within the cap 21. The cap 21 has an upwardly depending skirt 24 (when in the inverted orientation shown in the drawings) which forms the outer surface of the cap 21. Working inwardly from the skirt 24, the next feature of the cap is an outer annular wall 25 which is generally co-axial with the skirt 24. As is more clearly visible from the exploded view provided by FIG. 8D, the outer annular wall 25 consists of a pair of retaining members 26 and a pair of support members 27 which alternate with one another and each extend for approximately a quarter of the circle as shown. These members extend directly up from the lower wall of the cap 21, are parallel sided and have an inclined upper surface 28. While the support members 27 are fixed to the cap 21, the the retaining members are not fixed to the wall of the cap, but are instead fixed at either end to the support members 27 by frangible members 29. as best shown in FIGS. 6 and 8. These retaining members 26 are parallel sided and have an inclined upper surface 35.

As is seen in FIGS. 8A-8E, the neck 22 of the bottle has an inclined outer surface 36 which is complimentary to the inclined surfaces 28 and 35 of the annular wall 25. Behind the inclined outer surface 36 is a shoulder 37 which faces the main body of the bottle 20. This inclined outer surface 36 and shoulder 37 is only present in the vicinity of the retaining members 26 and not in the vicinity of the support members 27. Adjacent to the support members 27, the neck 22 has a parallel sided configuration. In order to insert the bottle 20 into the cap 21, the bottle 20 is pushed down with its neck fitting over the annular flange 23. The inclined outer surface 36 of the bottle co-operates with the inclined surfaces 28, 35 to displace the retaining members 26 radially outwardly until the shoulder 37 snaps into place behind the retaining members 26 as shown in FIG. 8E. When the bottle 20 is pulled off of the cap 21, the shoulders 37 bear against the retaining members 26, thereby breaking frangible members 29 so that the retaining members 26 become detached from the cap 21. Once this has happened, it is no longer possible to retain the cap on a bottle, thereby preventing subsequent use of the refill 1.

It should be noted that it is not necessary for both of the retaining members 26 to become fully detached from the lid. It is possible that only one of these becomes detached, or that one or both are simply displaced to a location at which they can no longer engage with the neck of the bottle.

The liquid outlet is provided by an annular wall 30 surrounding a central opening 31. At the top of the annular wall 30 is an inclined surface 32 which provides a valve seat for outlet valve element 33. This is shown in the form of a U-shape cup-like member, but may equally be a solid member or a hollow ball-like member. The outlet valve element 33 is biased into its closed position by a plurality of biasing elements 34. These are attached at their upper end towards the top of the valve element 33 and are attached at their lower ends at a location radially outward of the annular wall 30 and below the top of the annular wall 30. They are preferably formed integrally with the valve element 33. when the refill 1 is lowered into the base unit 2, the spigot 11 engages with the lower surface of the valve element 33 as shown in FIGS. 8B and 8C. Further downward movement of the refill 1 causes the valve element 33 to be lifted from its seat, and also brings the O-ring 14 into sealing engagement with the annular wall 30. The valve element 33 is lifted to the position shown in FIG. 8C. In this position, liquid in the bottle 20 can flow around the biasing elements 34, and enter the spigot via the castellations 13 and hence flow into the base unit 2. Liquid is prevented from escaping between the spigot 11 and annular wall 30 by the O-ring seal 14. This arrangement offers a simple and mess-free way for a consumer to insert a refill regardless of the fill level of the refill.

In order to remove a refill, the consumer lifts it out of the base whereupon the biasing elements 34 cause the valve element 33 to return to the seat 32. During this movement, the seal between the spigot 11 and annular wall 30 is maintained by the O-ring seal 14. A spent refill is then replaced by a new one following the above procedure. The cap is provided with a pair of pressure relief valves 40. Each is formed by an annular boss 41 integral with the cap 21. A pressure relief valve element 42 is seated on the top of the annular boss 41 and is biased in place by a pair of biasing elements 43. The biasing force is such that, under normal conditions, the pressure relief valve element 42 forms an air tight seal on the boss 41. However, when the pressure within the bottle 20 drops below a certain level, the pressure differential across the relief valve element 42 is sufficient to overcome the force exerted by biasing elements 43 and to allow air into the bottle 20. This reduces the pressure differential thereby restoring the air tight seal without leakage of fluid.

Each pressure relief valve 40 is surrounded by an annular barrier 44 which extends axially to a level axially above the level of the top of the annular wall 30. Thus, when the valve element 33 is open, any air entering the relief valve 40 will not become entrained in the outgoing liquid stream. In practice, this means that the relief valve can be placed closer to the outlet, thereby resulting in a more compact cap. Although two relief valves are shown, a single valve, or more than two valves could be provided if necessary.

The manner in which the cap is assembled can be understood from the illustration of FIG. 8D. The illustrated assembly is a three-part structure consisting of the cap 21, a valve plate 45 and a fixing plate 46. The cap has a number of molded features including the annular flange 23, annular wall 25 and annular bosses 41. In addition, the cap 21 has a plurality of fixing posts 47. The valve plate 45 is an elastomeric material and is integrally formed with the valve element 33, biasing elements 34, relief valve element 42 and biasing elements 43. The valve plate has a plurality of locating holes 48 which correspond to the fixing posts 47. The fixing plate 46 is made of a rigid plastics material and is integrally formed with the annular barrier 44. As with the valve plate 45, the fixing plate 46 is also provided with a plurality of locating holes 49 which correspond to the fixing posts 47.

The cap 21 may be assembled by assembling the depicted component parts of FIG. 8D with the fixing posts entering the locating holes to ensure that the components are correctly aligned. Heat or adhesive is then applied to the top of the fixing posts 47 to secure the fixing posts to the fixing plate 46. The elastomeric valve plate 45 is thereby sandwiched between the cap 21 and fixing plate 46 which holds the valve elements 33 and 42 in position.

An alternative embodiment of a cap 21 is disclosed with reference to FIGS. 9A and 9B, which is similar in many respects to the cap 21 illustrated and described with reference to FIGS. 8A-8E.

With reference now to FIGS. 9A and 9B, the structure of the outlet valve element 33 in the second example is essentially the same as cap of FIGS. 8A-8E. As is seen from the exploded view of the elements of the cap 21 presented in FIG. 9A, the cap 21 is integrally molded with a number of features, such as the annular walls 25 and 30 and a conical part 50 of the pressure relief valve. A resilient lip 53 for the pressure relief valve is provided integrally molded with the valve plate 45. The fixing plate 46 is also provided with a shield 57 for the relief valve, which shield 57 performs a similar function to that of the barrier 44. However the shield 57 only extends around the side of the relief valve facing the outlet valve element 33. It is to be appreciated that the barrier 44 and shield 57 could be used interchangeably in a cap 21. The cap assembly is assembled in the same manner as described with reference to the cap of FIG. 8D.

The pressure relief valve 60 is disclosed in more detail with reference to FIGS. 9C and 9D. The valve has the conical part 50 which is an integral part of the cap 21 as mentioned above. At the top of the conical part 50 is a cylindrical post 61. The resilient lip 53 is effectively a hollow frustoconical extension of the valve plate 52 of resilient material which extends along the conical part 50 from which it diverges slightly and is a tight fit against the post 61. At least one air inlet 62 passes through the wall of the conical part 50 and is normally covered by the resilient lip 53 as shown in FIG. 11. When the pressure in the bottle 20 falls as liquid is emptied the pressure differential across the resilient lip 53 will eventually become sufficient to displace the lip 53 to a sufficient degree to allow air A into the bottle 20 as shown by the arrows in FIG. 8. It should be noted that the degree to which the resilient lip 53 lifts from the conical element 50 has been exaggerated in FIG. 8 and that, in practice, this will be almost imperceptible. Instead of sealing against the post, the resilient lip 53 may seal against the conical part 50. In this case, the lip will not diverge from the conical part as shown. Instead, it would actually have an angle of incline less than the angle of the conical part 50 so as to be naturally biased onto the conical part.

A further alternative embodiment of a cap 21 is disclosed with reference to FIGS. 10A and 10B, which is similar in many respects to the cap 21 illustrated and described with reference to FIGS. 8A-8E.

As can be seen in FIGS. 10A and 10B, the outlet valve element 33' is shaped differently. In this case, there is a reduced diameter portion 60 which fits within the annular wall 30 when the valve is closed to assist the sealing to the annular wall and the pair of pressure relief valves 40 have been replaced by a single conventional umbrella valve 61. The depicted cap further differs from that illustrated in FIGS. 8A-8E in that the retaining members 26 with their frangible members 29 have been replaced by a plurality of intermittent shoulders 62 which engage with complementary shoulders 63 on the neck of the bottle 20. Inward deflection of the neck of the bottle is prevented by a flange 64. Once in position, the engagement between the shoulders is strong enough to prevent the cap from being removed from the bottle for all practical purposes. This is facilitated by a keying arrangement 64 on the cap 21 which engages with a complementary protrusion on the bottle (not shown) to prevent relative rotation between the cap 21 and bottle 20.

The invention claimed is:

1. A dispenser comprising a base unit and an articulated arm portion which extends from a part of the base unit, a fluid coupling having a fluid arm coupling part within the articulated arm portion which is movably connected via a fluid conduit to a fluid stem part which forms part of the base unit and wherein a fluid conduit is defined through a part of the fluid stem part and the fluid arm coupling part, the base unit further including an actuation mechanism which includes a capacitive-type sensor for dispensing liquid and adapted to receive a refill unit having a cap, the refill unit insertable into the base unit in an inverted configuration with its outlet lowermost for the supply of liquid to the base unit, the refill unit comprising an annular wall projecting into the refill unit and defining an outlet from the refill unit, the annular wall being closable at its innermost end by a valve element biased onto the annular wall by at least one resilient member, the valve element being interconnected to the resilient member, and a surrounding valve plate which is secured to the cap, the base unit comprising a hollow spigot and an annular seal surrounding and spaced from the top of the spigot whereby insertion of the refill unit into the base unit causes the spigot to enter the annular wall and to lift the valve element from the annular wall so to define a flow path from the refill unit, through at least one cut-out portion formed in the top of the spigot and/or the bottom of the valve element and down the hollow spigot, and the annular seal to seal between the spigot and the annular wall.

2. A dispensing device according to claim 1, wherein the at least one resilient member is joined at one end to the valve element and at the other end at a location radially outwardly of and below the innermost end of the annular wall, the or each resilient member being configured so that when the valve element is lifted from the annular wall, a flow path is present between the valve element and the annular wall.

3. A dispensing device according to claim 2, wherein there are a plurality of resilient elements with gaps therebetween to provide the flow path.

4. A dispensing device according to claim 1, wherein the valve element is manufactured integrally with each resilient member.

5. A dispensing device according to claim 1, wherein the valve plate is sandwiched between the cap and a fixing plate.

6. A dispensing device according to claim 5, wherein one or more fixing posts are provided in one of the cap, the valve plate or the fixing plate, in order to locate the various elements with respect to one another.

7. A dispensing device according to claim 1, wherein the refill unit is filled with a liquid having a viscosity greater than water.

8. A dispensing device according to claim 1, wherein fluid arm coupling part within the articulated arm portion includes a portion which is mountable about an exterior part of the fluid stem part.

9. A dispensing device according to claim 8 wherein the portion of the fluid arm coupling part mountable about an exterior part of the fluid stem part is rotatable with relation thereto.

10. A dispensing device according to claim 1 wherein the fluid arm coupling part is cross-shaped.

11. A dispensing device according to claim 1 wherein an O-ring forms a part of the fluid coupling.

* * * * *